US006443546B1

(12) United States Patent
Takagi

(10) Patent No.: US 6,443,546 B1
(45) Date of Patent: Sep. 3, 2002

(54) PRINTING APPARATUS AND CONTROL METHOD THAT INCLUDES AN OPTICAL DETECTOR FOR DETECTING THE PRESENCE OR ABSENCE OF AN INK TANK AND INK THEREIN

(75) Inventor: Shinji Takagi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/190,092

(22) Filed: Nov. 12, 1998

(30) Foreign Application Priority Data

Nov. 14, 1997 (JP) ..... 9-314096

(51) Int. Cl.[7] ..... B41J 2/195

(52) U.S. Cl. ..... 347/7; 347/19

(58) Field of Search ..... 347/7, 19; 356/445; 73/327; 116/227, 109; 340/619; 250/903, 577; 399/13.27

(56) References Cited

U.S. PATENT DOCUMENTS

| | | | | |
|---|---|---|---|---|
| 4,246,489 A | | 1/1981 | Yoshida et al. | 250/577 |
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,608,577 A | | 8/1986 | Hori | 346/140 |
| 4,723,129 A | | 2/1988 | Endo et al. | 346/1.1 |
| 4,740,796 A | | 4/1988 | Endo et al. | 346/1.1 |
| 4,836,682 A | * | 6/1989 | Keenan, III | 356/445 |
| 5,585,652 A | * | 12/1996 | Kamasz et al. | 257/231 |
| 5,596,351 A | * | 1/1997 | Stapleton | 347/7 |
| 5,753,931 A | * | 5/1998 | Borchers et al. | 250/559.22 |
| 5,975,665 A | * | 11/1999 | Torigoe et al. | 347/7 |
| 5,997,121 A | * | 12/1999 | Altfather et al. | 347/7 |
| 6,024,428 A | * | 2/2000 | Uchikata | 347/7 |

FOREIGN PATENT DOCUMENTS

| | | | |
|---|---|---|---|
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-31021 | 2/1985 | G01F/23/28 |
| JP | 60-71260 | 4/1985 | B41J/3/04 |
| JP | 2-102062 | 4/1990 | B41J/2/175 |
| JP | 7-218321 | 8/1995 | G01F/23/28 |

* cited by examiner

*Primary Examiner*—Craig A. Hallacher
(74) *Attorney, Agent, or Firm*—Fitzpatrick, Cella, Harper & Scinto

(57) ABSTRACT

A low-cost printing apparatus and printing control method through which the absence or presence of an ink tank and ink can be determined accurately regardless of the surrounding environment. The printing apparatus obtains the difference between a first signal, which is obtained from light received by a light-receiving element (16) in a case where a light reflecting surface (41) and an optical prism (42) are irradiated with light, and a second signal, which is obtained from light received by the light-receiving element (16) in a case where the light reflecting surface (41) and optical prism (42) are not irradiated with light, compares the difference with a predetermined threshold value and determines whether or not ink is present and/or whether or not the ink tank is present, based upon the result of the comparison.

20 Claims, 12 Drawing Sheets

PRINTING APPARATUS AND CONTROL METHOD THAT INCLUDES AN OPTICAL DETECTOR FOR DETECTING THE PRESENCE OR ABSENCE OF AN INK TANK AND INK THEREIN

BACKGROUND OF THE INVENTION

This invention relates to a printing apparatus and printing control method. More particularly, the invention relates to a printing apparatus and printing control method for discharging ink droplets in accordance with the ink-jet method and printing character, images and the like on a recording medium.

An ink-jet printing apparatus known in the art performs printing by discharging extremely small ink droplets from a printhead. In comparison with other types of printing apparatus, such an ink-jet printing apparatus not only produces little noise, makes possible high-speed printing and facilitates color printing but also can be used to print on printing media such as plain paper as a matter of course and fabric as well. The apparatus makes high-quality printing possible.

In general, the printhead of an ink-jet printing apparatus has one to two thousand orifices which discharge ink droplets. The printhead is caused to scan in relative to the printing medium to thereby perform printing over the entire area of the printing medium. In an actual printing operation, the printhead is mounted on a carriage, the carriage is moved back and forth along the traveling path thereof (the traveling direction is referred to as the "main-scan direction"), and the printing medium is conveyed in a direction (referred to as the "sub-scan direction") orthogonal to the carriage traveling direction a prescribed amount whenever the carriage is moved back and forth one time.

Usually an arrangement is adopted in which the printhead mounted on the carriage is mounted on the carriage removably or in which an ink tank containing the ink supplied to the printhead is removably attached to the printhead.

Thus, the structure of the conventional ink-jet printing apparatus is such that the ink tank is removably attached to the carriage or to the printhead. This makes it necessary for the printing apparatus to check automatically whether the ink tank has been installed in the printing apparatus correctly at the time of printing.

FIG. 11 is a perspective view showing a conventional detection principle for detecting whether an ink tank has been installed.

As shown in FIG. 11, an ink tank 102 containing ink 101 has a bottom provided with a light reflecting surface 103. A light-emitting element 104 such as an infrared LED emits light that is reflected by the light reflecting surface 103. The reflected light is received by a light-receiving element 105 such as a phototransistor. In a case where the ink tank 102 has been mounted correctly on the carriage of a printing apparatus, the light emitted by the light-emitting element 104 is reflected by the light reflecting surface 103 and reaches upon the light-receiving element 105. The latter converts the light to an electric signal in accordance with the amount of light received and issues an output signal (I) serving as a detection signal indicating that the ink tank has been installed.

If the ink tank 102 has not been mounted on the carriage, on the other hand, the light emitted by the light-emitting element 104 continues traveling straightforward and is not returned to the light-receiving element 105 owing to the absence of a reflecting body. Thus an electric signal generated by the light-receiving element 105 varies, depending in whether the ink tank 102 is mounted or not.

Thus, whether or not the ink tank is present can be discriminated based upon the erectric signal generated by the light-receiving element 105.

More specifically, let I represent the electric signal output by the light-receiving element 105. If the ink tank has been installed correctly, the electric signal output I will be I1. If the ink tank has not been installed, however, the electric signal output I of the light-receiving element 105 will be "0". This conventional art assumes that no extraneous light enters into the apparatus. Thus, the output of the light-receiving element 105 differs depending upon whether the ink tank is present or not.

If $\alpha$ is decided beforehand to satisfy the inequality $0<\alpha<I1$ and the output (I) of the light-receiving element 105 is greater than $\alpha$, then it is judged that the ink tank 102 has been installed.

In the prior art, the ink-jet printing apparatus is provided with means inclusive of a sensor, which is fixed to the main body of the apparatus, for automatically detecting existence/absence of ink in the ink tank by utilizing the movement of the carriage and alerting the user based upon the result of the sensing operation. For example, the residual ink detection means includes electrodes provided within the ink tank and measures the electrical conductivity between the electrodes or is adapted to sense discharged ink droplets optically. In general, the method using the electrodes results in a more complicated structure for the ink tank itself. For this reason, the most usual practice is to adopt the means for detecting existence/absence of ink in optical fashion.

An ink-jet printhead or an ink tank equipped with detecting means for optically detecting residual ink is disclosed in the specifications of Japanese Patent Application Laid-Open (KOKAI) Nos. 60-31021, 2-102062 and 7-218321.

FIG. 12 is a diagram showing an example of the conventional arrangement of an ink detection unit for optically detecting whether ink is present or not.

As shown in FIG. 12, the ink tank 102, which comprises a member such as semi-transparent plastic having a light transmitting property, accommodates ink 101. The bottom of the ink tank 102 is formed to have an optical prism 106 that performs the function of an optical ink sensing unit. Here the optical prism 106 is a triangular prism having an apex angle of 90°. The optical prism 106 consists of a nearly transparent material such as polypropylene and is formed as an integral part of the ink tank 102.

Light emitted from the light-emitting element 104 under conditions in which there is no ink in the ink tank 102 reaches the light-receiving element 105 upon being reflected at boundary surfaces 106A, 106B between the optical prism 106 and ink 101. Let the electric signal output,I from the light-receiving element 105 under these conditions be represented by I2.

Under conditions where the ink tank 102 is filled with the ink 101, the reflectance of the emitted light at the boundary surfaces 106A, 106B differs from that in the absence of ink owing to the refractive indices of the ink tank 102 itself and ink 101. As a result, there is a reduction in the amount of light from the light-emitting element 104 that arrives at the light-receiving element 105 via the boundary surfaces 106A, 106B. Accordingly, the output (I) of the light-receiving element 105 in this case satisfies the equation $I=I3<I2$. Thus, it is possible to detect whether or not the ink 101 is present within the ink tank 102 based upon the amount of light sensed by the light-receiving element 105.

Thus, the output of the light-receiving element 105 differs depending upon whether the ink 101 is present or not.

If β is decided beforehand to satisfy the inequality $0<I3<\beta<I2$ and the output (I) of the light-receiving element 105 is greater than β, then it is judged that there is no ink in the ink tank 102.

However, various factors in addition to the light from the light-emitting element 104 contribute to the output of the light-receiving element 105 and cause the output to fluctuate.

For example, the phototransistor used in the light-receiving element 105 produces current (referred to as "dark current") even when it is not receiving light. The output of dark current depends upon the ambient temperature and rises exponentially as the temperature rises. In addition, there is the possibility that extraneous light, not the light for which the light-emitting element 104 is the source, will reach upon the light-receiving element 105. The extraneous light is such that the amount of incident light varies depending upon angle of incidence with respect to the light-receiving element 105 and, as a result, the output of the light-receiving element 105 varies.

Thus, the output of the light-receiving element 105 is influenced greatly by dark current and by the surrounding environment, such as extraneous light. Consequently, it is very difficult to decide α and β in advance so as to satisfy the above-mentioned conditions independently of the environment.

In order to eliminate the influence of dark current, it is possible to provide a thermal insulating mechanism or temperature correction circuit in order to hold the temperature of the light-receiving element 105 constant. This is disadvantageous, however, in that it raises the cost of the apparatus. To eliminate the effects of extraneous light, the interior of the apparatus can be structured so that extraneous light will not enter. To print on a printing medium, however, it is required that the printing apparatus must have openings, namely a paper feed port through which printing paper (the printing medium) is fed into the apparatus from the outside, and a paper discharge port from which the printing paper is discharged to the exterior of the apparatus after the paper is printed on. The presence of these openings makes it very difficult to realize a structure that does not allow light to enter the interior of the apparatus.

SUMMARY OF THE INVENTION

Accordingly, an object of the present invention is to provide an low-cost printing apparatus in which it is possible to judge accurately, regardless of the surrounding environment, whether an ink tank or ink is present or not, as well as a method of controlling printing in such an apparatus.

According to one aspect of the present invention, the foregoing object is attained by providing a printing apparatus for supplying ink from an ink tank, which includes a light reflecting portion used for optically detecting whether or not ink is present, or whether or not the ink tank is present, and performing printing using a printhead according to an ink-jet method, the apparatus comprising:

a light-emitting unit for emitting light to the light reflecting portion; a light-receiving unit for receiving light; difference calculating means for calculating a difference between a first signal, which is obtained from light received by the light-receiving unit in a case where the light-emitting unit emits the light, and a second signal, which is obtained from light received by the light-receiving means in a case where the light-emitting means emits no light;

judgment means for judging whether or not ink is present and/or whether or not the ink tank is present, based upon the difference calculated by the difference calculating means with a predetermined threshold value.

Preferably, the judgement means includes comparison means for comparing the difference obtained by the difference calculating means with a predetermined threshold value, and the judgment means judges whether or not ink is present, or whether or not the ink tank is present, based on result of comparison by the comparison means.

Preferably, the ink tank has a plurality of light reflecting portions, the plurality of light reflecting portions includes a first light reflecting portion used for optically detecting whether or not ink is present and a second light reflecting portion used for optically detecting whether or not the ink tank is present, and the judgment means judges whether or not ink in the ink tank is present based on result of detection by the first light reflecting potion, while judges whether or not the ink tank is present based on result of detection by the second light reflecting portion.

Preferably, the apparatus further comprises printing control means for performing printing control in accordance with the judgment made by the judgment means. Note that the printing control way include suspension of printing, display of a message prompting replacement or attachment of the ink tank and resumption of printing.

Preferably, the first light reflecting portion is a light-transmissive optical prism provided on a bottom surface of the ink tank, and the second light reflecting portion is a light reflecting surface provided on the bottom surface of the ink tank.

The apparatus may further comprise a scanning unit mounting an ink cartridge integrating the printhead and the ink tank, and reciprocally moving the ink cartridge. It is further preferable that the first and second light reflecting portions are provided along scanning directions of the scanning unit.

In a preferred embodiment, the light-emitting unit and the light-receiving unit are provided in the vicinity of a traveling path of the ink cartridge, the light-emitting unit is an LED for emitting infrared light, and the light-receiving unit is a phototransistor for receiving the infrared light and converting the received infrared light to an electric signal.

In a preferred embodiment, an arrangement may be adopted in which the first and second signals are obtained at the same position where the ink tank is situated on the traveling path of the ink cartridge. In this case the signals can be obtained when the ink cartridge is stopped immediately above a position at which the light-emitting unit and light-receiving unit are provided.

Alternatively, in another preferred embodiment, the light-emitting unit is controlled in such a manner that a plurality of the first signals are obtained while the ink cartridge is beng moved in the vicinity of the position at which the light-emitting unit and light-receiving unit are provided, a maximum value of the first signals is calculated from the plurality of the first signals obtained by this control, and control is performed so as to stop emission of light by the light-emitting means and obtain the second signal by the light-receiving unit at a location at which the maximum value of the first signals is obtained.

In still another preferred embodiment, control is performed in such a manner that a plurality of each of the first and second signals are obtained while the ink cartridge is being moved in the vicinity of the position at which the light-emitting unit and light-receiving unit are provided, a difference is obtained between the first and second signals, from the pluralities of first and second signals obtained by this control, at each position where positions at which the pluralities of first and second signals are acquired correspond, a maximum value of a plurality of these differences is calculated, the maximum value of the differences obtained is compared with a predetermined threshold value and whether or not the ink tank is present is judged, based upon the result of the comparison.

The printhead preferably is provided with an electrothermal transducer for generating thermal energy applied to the ink in order to discharge the ink by utilizing thermal energy.

According to another aspect of the present invention, the foregoing object is attained by providing a printing control method used when supplying ink from an ink tank, which includes a first light reflecting portion used for optically detecting whether or not ink is present, or whether or not the ink tank is present, and performing printing using a printhead according to an ink-jet method, the method comprising:

a first signal acquisition step of acquiring a first signal obtained from light received at a light-receiving portion in a case where the light reflecting portion is irradiated with light; a second signal acquisition step of acquiring a second signal obtained from light received at the light-receiving portion in a case where the first and/or second light reflecting portions are not irradiated with light; a difference calculation step of calculating a difference between the first and second signals; a judgment step of judging whether or not ink is present and/or whether or not the ink tank is present, based upon the difference obtained at the difference calculation step with a predetermined threshold value; and a printing control step of performing printing control in accordance with the judgment resultrendered at the judgment step.

In accordance with the present invention as described above, when printing by a printhead according to an ink-jet method by supplying ink from an ink tank, which has a light reflecting portion used to optically detect whether or not ink is present, or whether or not an ink tank is present, a difference is obtained between a first signal, which is obtained from light received at a light-receiving portion in a case where the light reflecting portion is irradiated with light, and a second signal, which is obtained from light received at the light-receiving portion in a case where the first and second light reflecting portions are not irradiated with light, and whether or not ink is present, or whether or not the ink tank is presented is judged based upon the difference is compared with a predetermined threshold value.

The invention is particularly advantageous in that even if noise that affects the judgment concerning existence/absence of the ink or ink tank is produced at the light-receiving portion or even if extraneous light accidentally reaches upon the light-receiving portion, such influence can be eliminated so that judgment concerning the presence/absence of the ink and/or ink tank can be rendered accurately.

Further, since special components are not necessary to achieve the above-mentioned effects, another advantage is that the judgment concerning the presence/absence of the ink and/or ink tank can be rendered accurately at low cost.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

Figure 1:
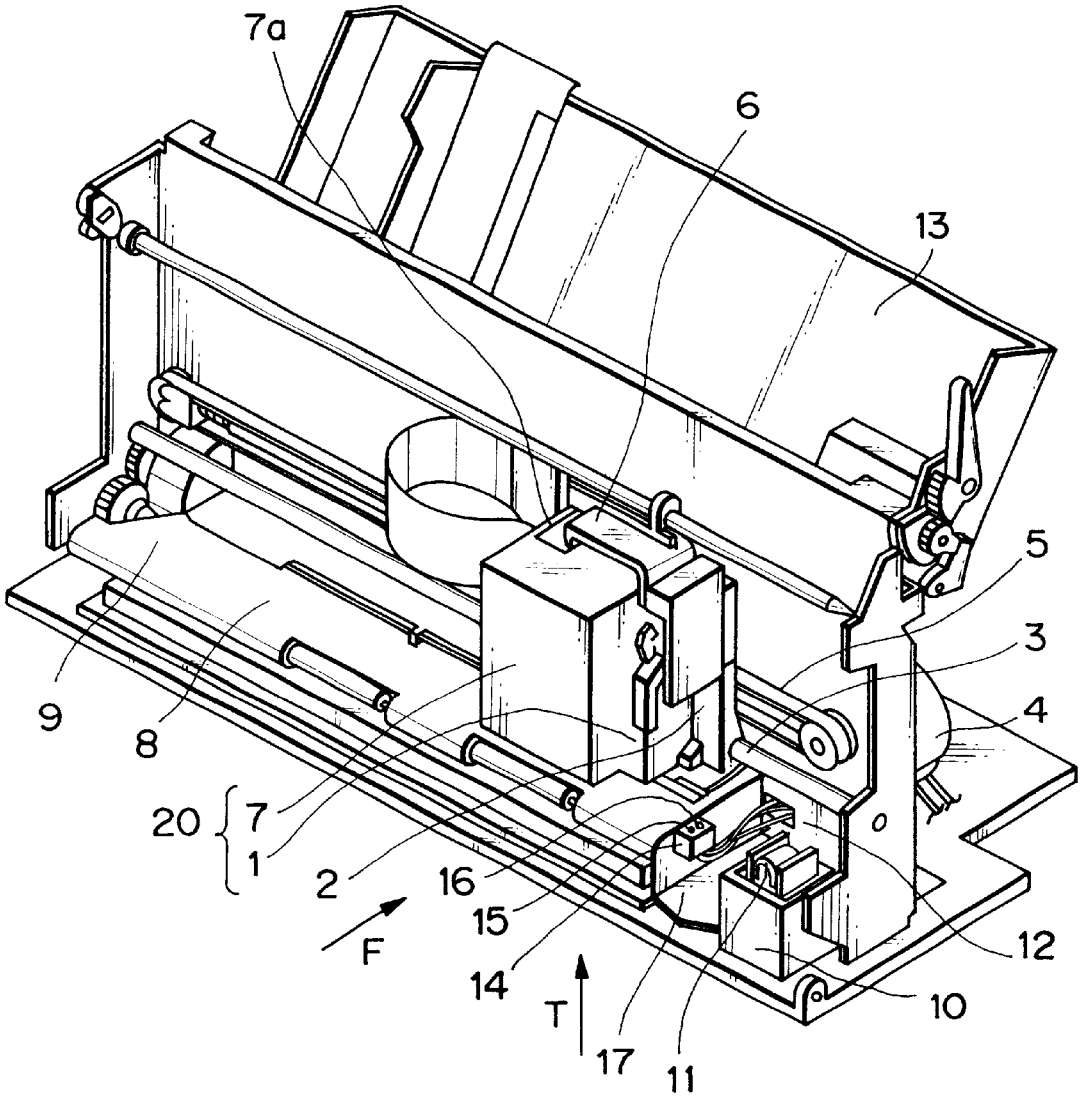
FIG. 1 is a perspective view showing the construction of a printing apparatus having a printhead which performs printing in accordance with the ink-jet method in a typical embodiment of the present invention.

FIG. 1 is a perspective view showing the construction of a printing apparatus having a printhead which performs printing in accordance with the ink-jet method in a typical embodiment of the present invention. According to this embodiment, an ink cartridge 20 integrates a printhead 1 and an ink tank 7 for supplying ink to the printhead 2, as shown in FIG. 1. The ink tank 7 has a bottom provided with a light reflecting surface, finished to a smoothed surface to obtain a high reflectivity, which is used for detecting whether an ink tank is present or not, and an optical prism used for detecting whether ink is present or not.

As shown in FIG. 1, the printhead 1 is mounted on a carriage 2 in an attitude in which the printhead 1 discharges ink droplets to form an image on a printing medium (not shown) such as a printing paper while the carriage 2 is moved along a guide shaft 3. The carriage 2 is moved to the left and right (back and forth) via a timing belt 5 by rotating a carriage motor 4. The carriage 2 is provided with a latch 6 which engages with a recess 7*a* in the ink tank to secure the ink tank to the carriage.

When printing corresponding to one scan of the printhead 1 ends, printing is suspended, the printing medium situated on a platen 8 is conveyed a predetermined amount by a feed motor 9, then printing corresponding to the next scan of the printhead 1 is performed while the carriage 2 is moved along the guide shaft 3 again.

Disposed on the right side of the apparatus is a recovery device 10 which performs a recovery operation to maintain the ink discharge state of the printhead 1. The recovery device 10 is provided with a cap 11 for capping the printhead 1, a wiper 12 for wiping off the ink discharge face of the printhead 1, and a suction pump (not shown) for sucking ink from the ink discharge nozzles of the printhead 1.

The driving force of the feed motor 9 for conveying the printing medium is transferred to an automatic sheet feeder (ASF) 13 in addition to the mechanism that conveys the printing medium.

An optical unit 14, which comprises an infrared LED (light-emitting element) 15 and a phototransistor (light-receiving element) 16, for detecting whether or not the ink tank is present and/or whether or not ink in the ink tank is present is provided alongside the recovery device 10. The optical unit 14 is mounted on a chassis 17 of the apparatus main body. The ink cartridge 20 is mounted on the carriage 2. When the carriage is moved to the right from the position illustrated in FIG. 1, the ink cartridge 20 arrives at a position situated above the optical unit 14. As a result, light reflected from the bottom surface of the ink tank 7 can be sensed by the optical unit 14 (the details of which will be described later).

An arrangement for executing the printing control of the apparatus set forth above will now be described.

Figure 2:
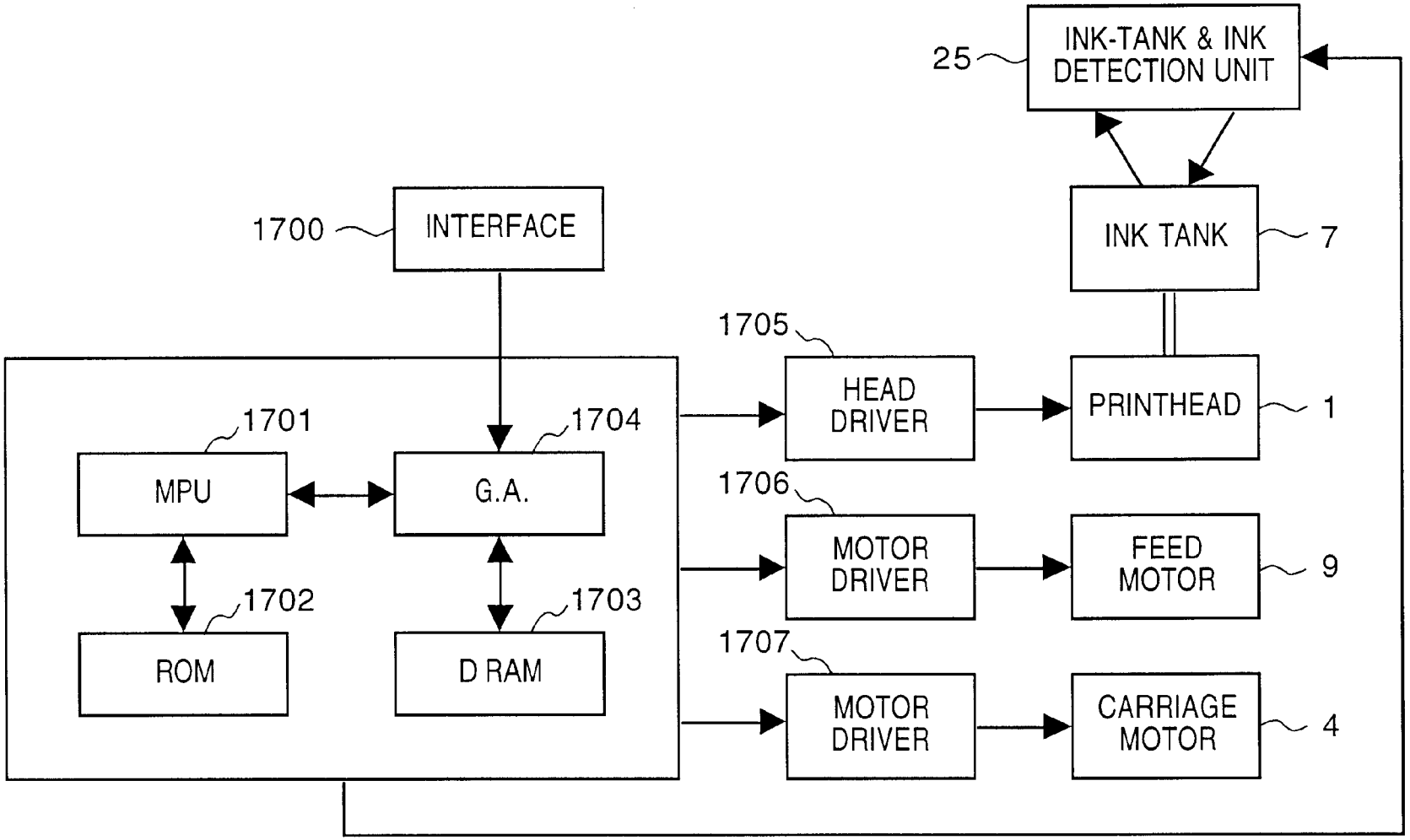
FIG. 2 is a block diagram showing the construction of a control circuit in the printing apparatus.

FIG. 2 is a block diagram showing the construction of the control circuit in the printing apparatus. The control circuit includes an interface 1700 for entering a printing signal, an MPU 1701, a ROM 1702 storing a control program executed by the MPU 1701, a DRAM 1703 for retaining various data (the printing signal and printing data, which is supplied to the printhead 1), a gate array (G.A.) 1704 for controlling the supply of print data to the printhead 1 and the transfer of data among the interface 1700, MPU 1701 and RAM 1703, a head driver 1705 for driving the printhead 1, and motor drivers 1706, 1707 for driving the feed motor 9 and carriage motor 4, respectively.

In terms of operation, the printing signal is input to the interface 1700, whereupon the printing signal is converted by the gate array 1704 and MPU 1701 to print data. The printhead 1 is driven to perform printing in accordance with the print data sent to the head driver 1705.

The operation of an ink tank and ink detection unit 25 for detecting whether or not the ink tank 7, integrated with the printhead 1, is present, and for detecting whether or not ink is present is controlled by the MPU 1701.

Figure 3:
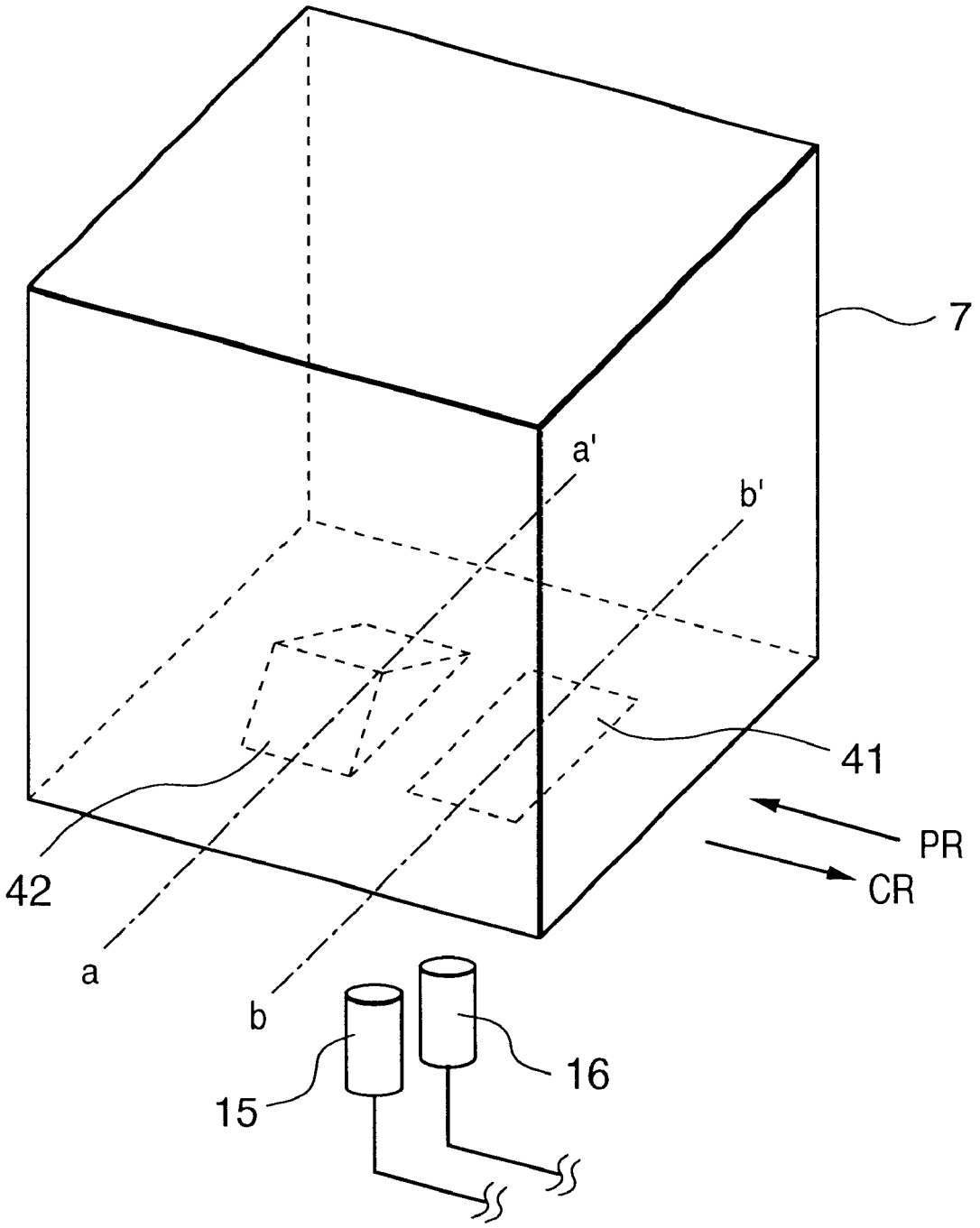
FIG. 3 is a perspective view showing the three-dimensional structure of the bottom of an ink tank 7.

FIG. 3 is a perspective view showing the three-dimensional structure of the bottom of an ink tank 7.

As shown in FIG. 3, the bottom of the ink tank 7 is provided with a light reflecting surface 41 and an optical prism (a triangular prism the apex angle of which is 90°) 42 along the traveling directions (PR and CR) of the carriage 2. When the carriage 2 is moved in the CR or PR direction, light from the light-emitting element 15 incorporated in the optical unit 14 illuminates the bottom surface of the ink tank 7, whereupon the light-receiving element 16 receives light reflected from the light reflecting surface 41 and light reflected from the optical prism 42.

The detecting of whether or not ink is present will be described first, followed by a description of the detecting of whether or not the ink tank is present.

(1) Detecting whether or not ink is present

Figure 4:
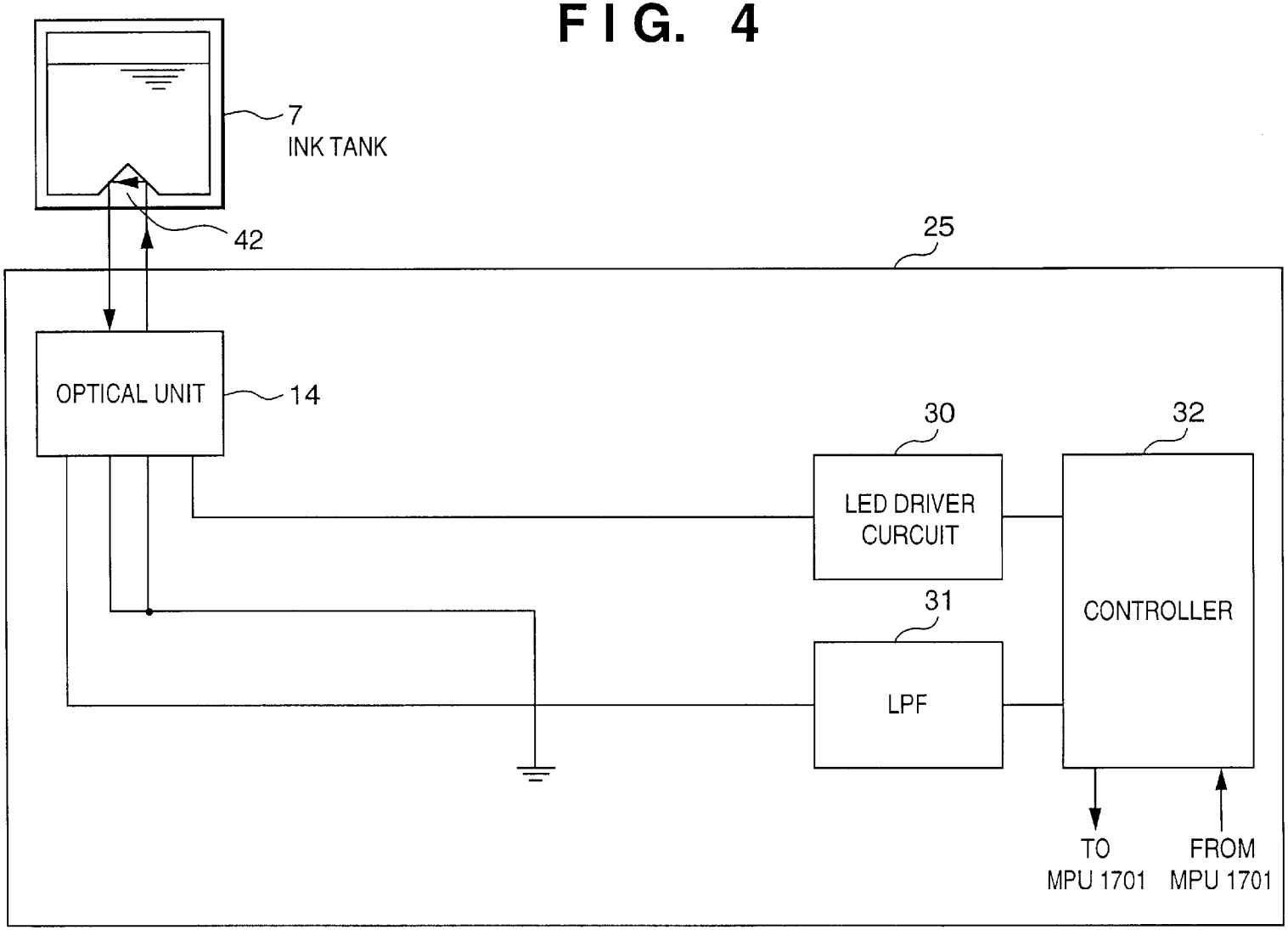
FIG. 4 is a block diagram showing in detail the construction of the ink tank 7 and an ink tank and ink detection unit 25.

FIG. 4 is a block diagram showing in detail the construction of the ink tank and ink detection unit 25.

FIG. 4 illustrates a cross section of the ink tank 7 in a case where a straight line a–a' shown in FIG. 3 is situated immediately above the optical unit 14.

In the arrangement shown in FIG. 4, a controller 32 outputs a pulse signal having a predetermined duty ratio (%) to an LED driver circuit 30 on the basis of a control signal from the MPU 1701, thereby driving the light-emitting element 15 of the optical unit 14 in accordance with the duty ratio and irradiating the optical prism 42, which is provided on the bottom of the ink tank 7, with infrared light.

The infrared light is reflected by the optical prism 42 on the bottom of the ink tank 7 and the reflected light returns to the light-receiving element 16 of the optical unit 14. The light-receiving element 16, which is a phototransistor, converts the received light to an electric signal and outputs the electric signal to a low-pass filter (LPF) 31. The low-pass filter 31 cuts high-frequency noise from the electric signal that arrives from the light-receiving element 16 and sends only a low-frequency signal to the controller 32. The controller 32 converts the analog signal from the low-pass filter 31 to a digital signal. The value of the converted signal is transferred to the MPU 1701.

FIGS. 5A through 5D are diagrams showing a change in the output of the light-receiving element 16 in accordance with movement of the ink tank 7 in a case where the optical prism 42 is situated immediately above or near the optical unit 14.

Figure 5A:
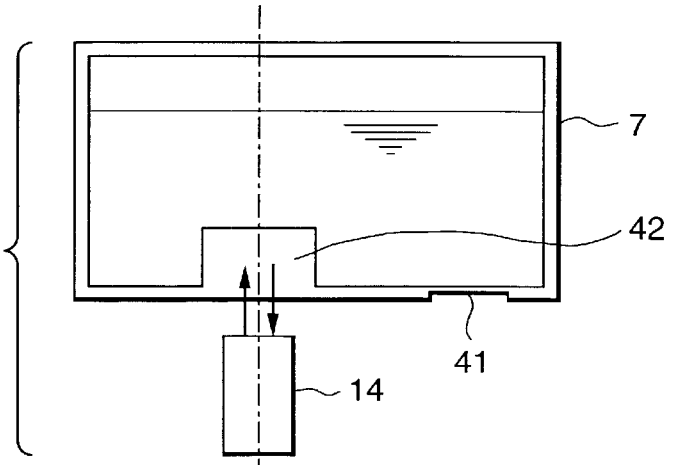
FIGS. 5A, 5B, 5C and 5D are diagrams showing a change in the output of a light-receiving element 16 in accordance with movement of the ink tank 7 in a case where an optical prism 42 is situated immediately above an optical unit 14.
Figure 5B:
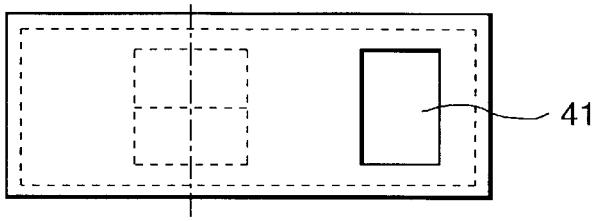
Figure 5C:
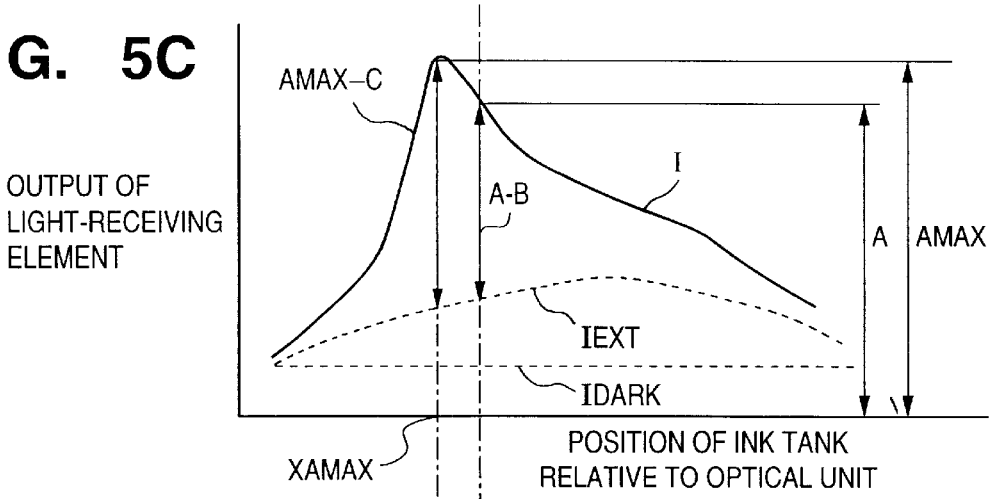
Figure 5D:
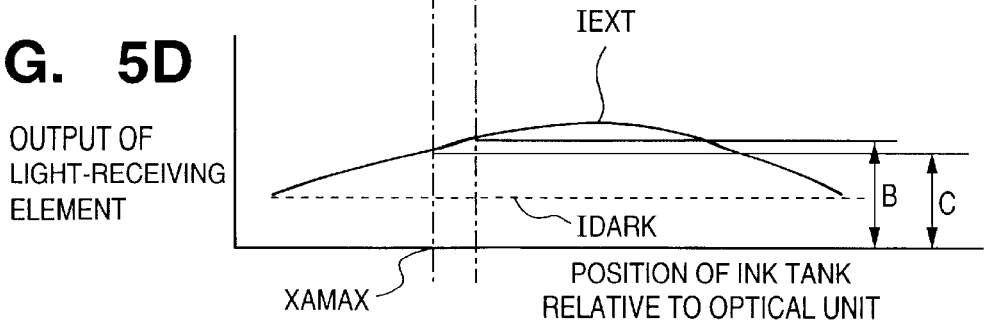

FIG. 5A is a diagram showing the optical unit 14 and the ink tank 7 as seen from the CR direction in FIG. 3, and FIG. 5B is a diagram in which the ink tank 7 is seen from the bottom thereof at this time. FIG. 5C is a diagram showing a change in the output of the light-receiving element 16 when light is emitted by the light-emitting element 15 and the ink tank 7 has been moved by travel of the carriage 2 in the absence of ink in the ink tank 7. FIG. 5D is a diagram showing a change in the output of the light-receiving element 16 when light is not emitted by the light-emitting element 15 and the ink tank 7 has been moved by travel of the carriage 2 in the absence of ink in the ink tank 7.

As indicated by FIG. 5D, a dark current IDARK and an output IEXT ascribable to the contribution of extraneous light are produced by the light-receiving element 16 even when light is not emitted by the light-emitting element 15. In other words, the output (I) of the light-receiving element 16 when the light-emitting element 15 is not emitting light is represented by $$I = I_{DARK} + I_{EXT}$$

As will be understood from FIG. 5D, the dark current IDARK results in a fixed output that is independent of the position of the ink tank 7 relative to the optical unit 14. The amount of extraneous light incident upon the light-receiving element 16, on the other hand, varies depending upon the position of the ink tank 7. This is because, depending upon the position of the ink tank 7, the light-receiving element 16 of the optical unit 14 is shielded from extraneous light by the ink tank 7. As will be appreciated from FIG. 5D, therefore, the output IEXT due to extraneous light varies depending upon the position of the ink tank 7 relative to the optical unit 14.

The dark current IDARK and the output IEXT due to extraneous light are produced also when light is emitted by the light-emitting element 15 (this is the situation illustrated in FIG. 5C) in a manner similar to that shown in FIG. 5D. Of course, the output I2 due to reflected light from the optical prism 42 is produced as well (the value of I2 being the same as the value of I2 described in the example of the prior art). Accordingly, the output (I) of the light-receiving element 16 when light is emitted by the light-emitting element 15 is expressed as follows:

$$I=IDARK+IEXT+I2$$

Further, in a case where there is no ink in the ink tank 7, the amount of light received reaches maximum when the optical prism 42 is situated immediately above the optical unit 14.

Processing for optically detecting whether or not ink is present using the printing apparatus having the construction set forth above will now be described with reference to the flowchart of FIG. 6. It is assumed that this processing is executed when the optical prism 42 of the ink tank 7 mounted on carriage 2 has been moved to the position immediately above the optical unit 14, as indicated by the dot-and-dash line in FIGS. 5A through 5D.

Figure 6:
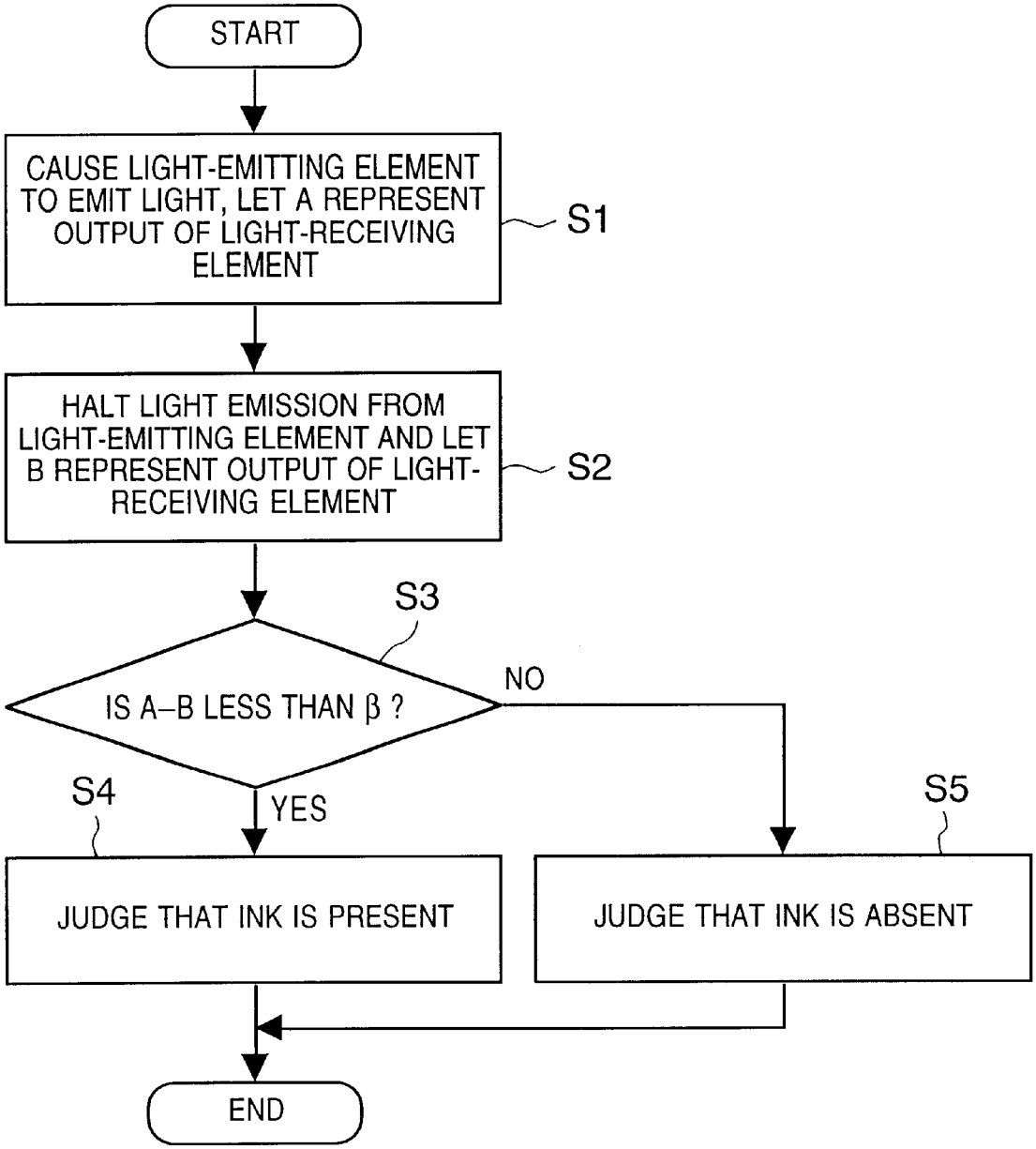
FIG. 6 is a flowchart illustrating processing for optically detecting whether ink is present or not.

First, at step S1 in FIG. 6, the controller 32 drives the light-emitting element 15 via the LED driver circuit 30 in response to a command from the MPU 1701. Light emitted by the light-emitting element 15 impinges upon the optical prism 42 and light reflected by the optical prism 42 returns to the light-receiving element 16. At this time the light-receiving element 16 receives not only light from the light-emitting element 15 but also extraneous light, and the output of the light-receiving element 16 is influenced by dark current as well. The high-frequency components of the output (I) from light-receiving element 16 obtained at this time are filtered, the value obtained by the analog-to-digital conversion of the filtered output is expressed by "A" and is stored in the DRAM 1703 (see "A" in FIG. 5C).

This is followed by step S2, at which the light emission from the light-emitting element 15 is halted, the high-frequency components of the output (I) from light-receiving element 16 obtained at this time are filtered, the value obtained by the analog-to-digital conversion of the filtered output is expressed by "B" and is stored in the DRAM 1703 (see "B" in FIG. 5D), in a manner similar to that of step S1.

Next, at step S3, the MPU 1701 calculates the value of (A−B) and compares this value with a predetermined threshold value (β). If (I3<) $(A-B)\leqq\beta$ holds, control proceeds to step S4, at which a judgment is rendered to the effect that ink is present. If $(A-B)>\beta$ holds, control proceeds to step S5, where it is judged that there is no ink present. Printing control (e.g., suspension of printing, display of a message prompting replacement of the ink tank, execution of printing, etc.) in accordance with each judgment rendered is carried out following step S4 or S5.

In accordance with the embodiment described above, executing the processing shown in the flowchart of FIG. 6 eliminates the influence of dark current and extraneous light by removing the amount of light due to the contribution of extraneous light and dark current so as to extract an amount of light ascribable to the contribution from the light-emitting element 15. As a result, whether ink is present or not can be judged more accurately.

In the event that extraneous light penetrates into the interior of the printing apparatus, the contribution of this extraneous light can be canceled by keeping the carriage 2 at the same position and obtaining the difference between the output of the light-receiving element when the light-emitting element emits light and the output of the light-receiving element when the light-emitting element does not emit light. This is advantageous in that the judgment concerning the presence/absence of ink is not affected even if the influence of extraneous light varies depending upon the position of the carriage (i.e., the position of the ink tank) relative to the optical unit.

In the embodiment described above, the processing for detecting whether ink is present or not is executed in a case where the center of the optical prism 42 provided on the ink tank 7 is situated immediately above the center of the optical unit 14, as indicated by the dot-and-dash line in FIGS. 5A through 5D. However, the present invention is not limited by this arrangement. For example, the processing for detecting whether or not ink is present may be executed when one end of the optical prism 42 of the ink tank 7 has just arrived immediately above the optical unit 14.

Figure 7:
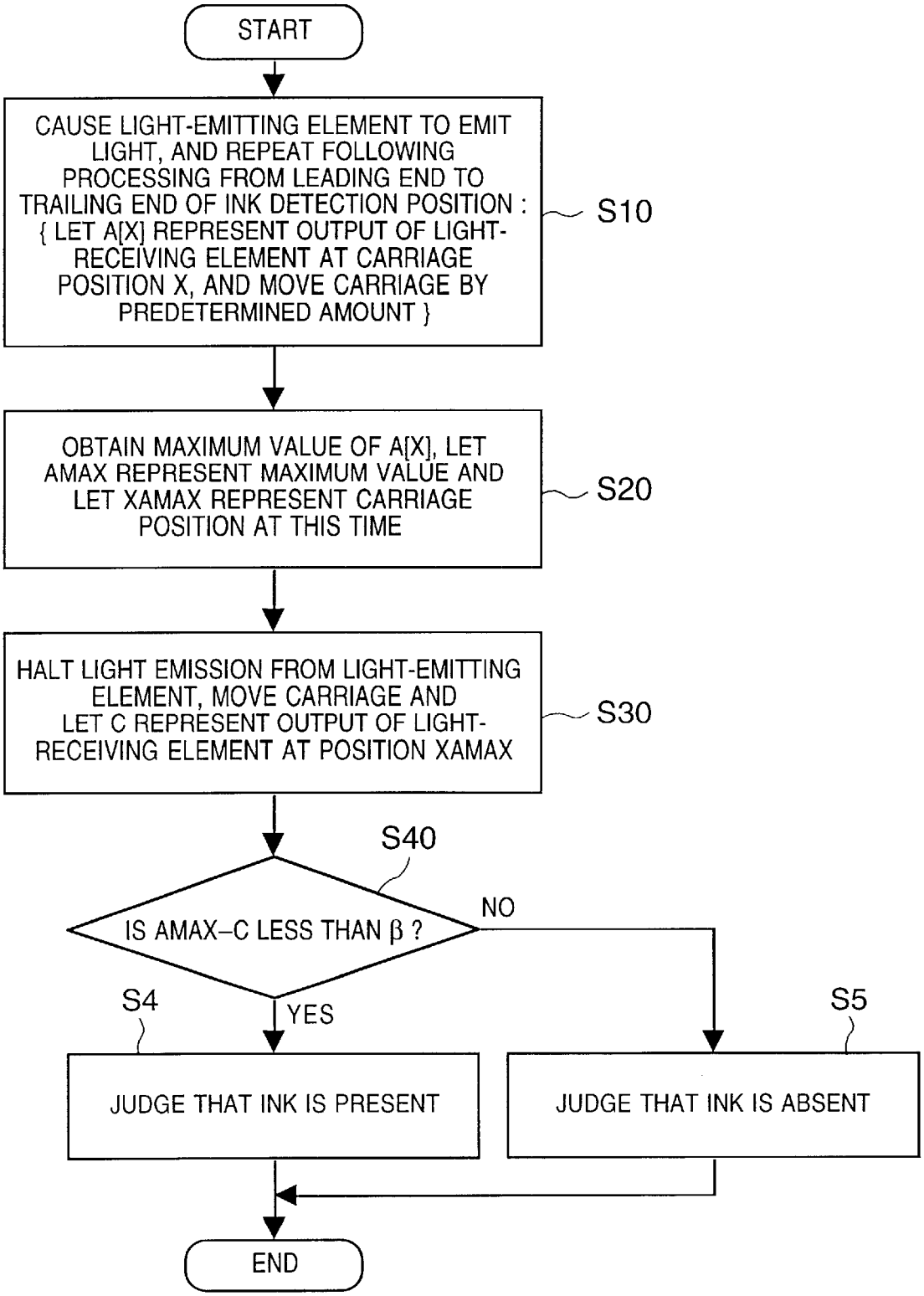
FIG. 7 is a flowchart illustrating another embodiment of processing for detecting whether ink is present or not.

At such a time the processing would be executed in accordance with the flowchart shown in FIG. 7.

The processing in this case will now be described in detail with reference to this flowchart.

First, at step S10, the MPU 1701 drives the light-emitting element 15 via the LED driver circuit 30, the output of the light-receiving element 16 is entered successively at predetermined time intervals while the carriage 2 is moved a predetermined amount, and the digital input values obtained are correlated with the relative positions of the ink tank 7 with respect to the optical unit 14 and stored in the DRAM 1703 as an array A[X], where X represents a relative position when the output of the light-receiving element 16 is entered and A[X] represents the digital value of the output from the light-receiving element 16 at the relative position X.

Next, at step S20, the maximum value of the stored input values is obtained, this maximum value is made AMAX and the position at that time is made XAMAX (refer to "AMAX" and "XAMAX" in FIG. 5C).

This is followed by step S30, at which the MPU 1701 halts the emission of light from the light-emitting element 15 via the controller 32 and LED driver circuit 30, moves the carriage 2 to a position indicated by XAMAX, enters the digital value obtained from the light-receiving element 16 at this time and stores this digital value in the DRAM 1703 as C (refer to "C" in FIG. 5D).

Control then proceeds to step S40, at which the MPU 1701 calculates AMAX-C and compares the calculated value with the predetermined threshold value β. The MPU 1701 then executes the processing of step S4 or S5 in the manner described above.

(2) Detecting whether or not an ink tank is present

Figure 8:
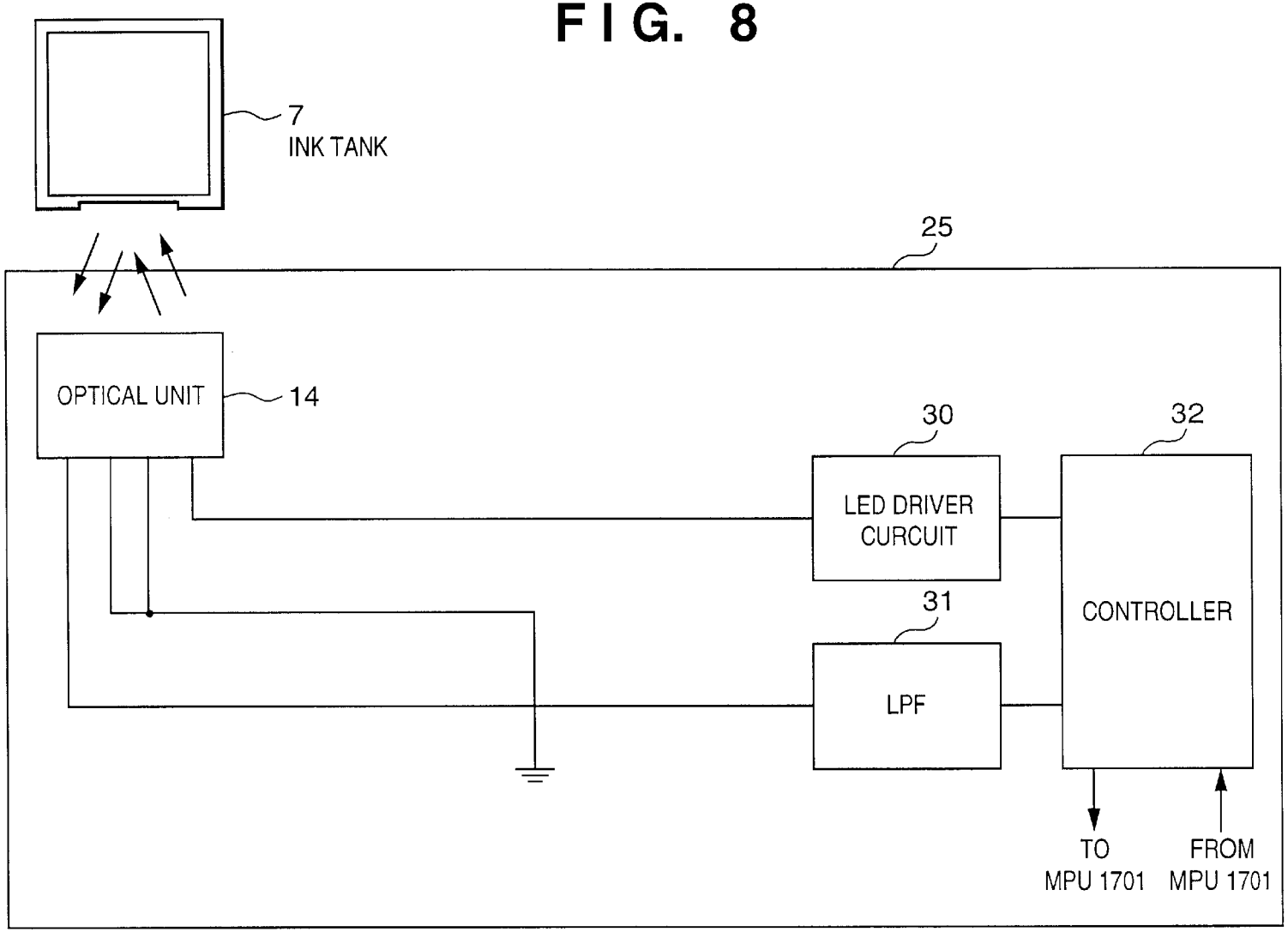
FIG. 8 is a block diagram showing in detail the construction of the ink 7 tank and the ink tank and ink detection unit 25 according to another embodiment.

FIG. 8 is a block diagram showing in detail the construction of the ink tank and ink detection unit 25.

FIG. 8 illustrates a cross section of the ink tank 7 in a case where a straight line b–b' shown in FIG. 3 is situated immediately above the optical unit 14.

In this case the driving of light-emitting element 15 for the emission of light and the processing of the signal received by the light-receiving element 16 are the same as described in conjunction with FIG. 4 and need not be described again.

FIGS. 9A through 9D are diagrams showing a change in the output of the light-receiving element 16 in accordance with movement of the ink tank 7 in a case where the light reflecting surface 41 is situated immediately above or near the optical unit 14.

Figure 9A:
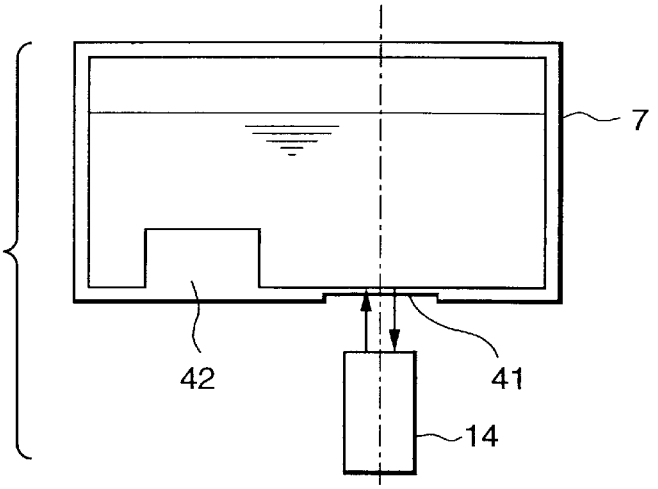
FIGS. 9A, 9B, 9C and 9D are diagrams showing a change in the output of the light-receiving element 16 in accordance with movement of the ink tank 7 in a case where a light reflecting surface 41 is situated immediately above the optical unit 14.
Figure 9B:
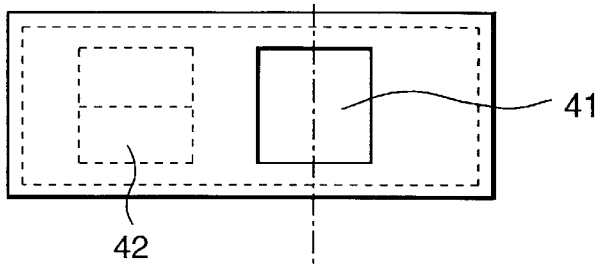
Figure 9C:
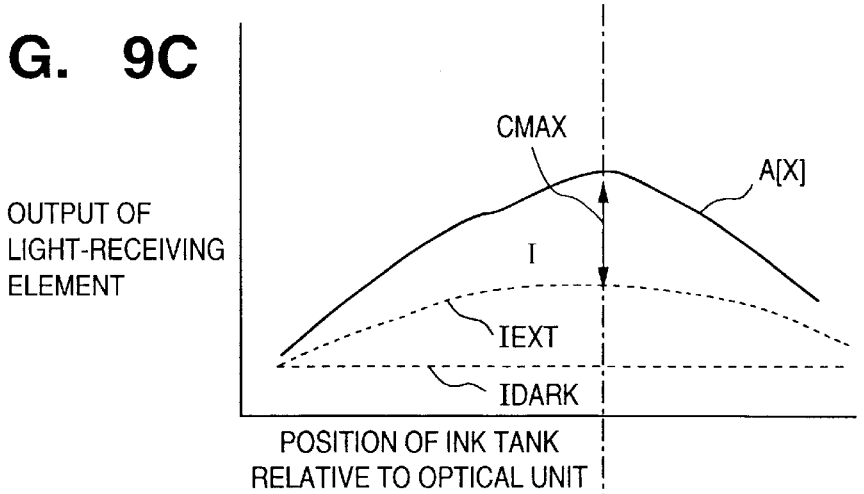
Figure 9D:
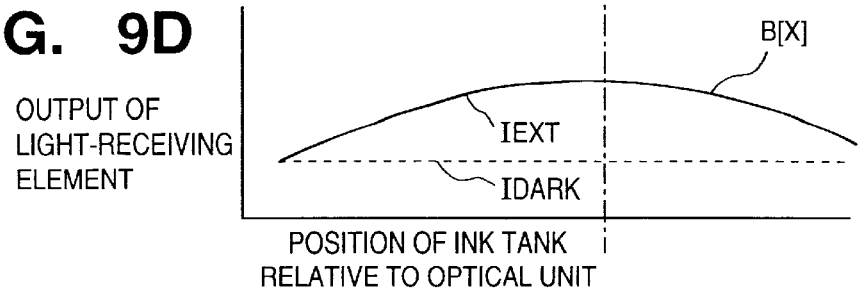

FIG. 9A is a diagram showing the optical unit 14 and the ink tank 7 as seen from the CR direction in FIG. 3, and FIG. 9B is a diagram in which the ink tank 7 is seen from the bottom thereof at this time. FIG. 9C is a diagram showing a change in the output of the light-receiving element 16 when light is emitted by the light-emitting element 15 and the ink tank 7 has been moved by travel of the carriage 2 in a case where the ink tank 7 is present. FIG. 9D is a diagram showing a change in the output of the light-receiving element 16 when only the carriage 7 is moved and light is not emitted by the light-emitting element 15 in a case where the ink tank 7 is absent.

As indicated by FIG. 9D, the dark current IDARK and the output IEXT ascribable to the contribution of extraneous light are produced by the light-receiving element 16 even when light is not emitted by the light-emitting element 15. This is similar to the case shown in FIG. 5D. In other words, the output (I) of the light-receiving element 16 when the light-emitting element 15 is not emitting light is represented by $$I = I\mathrm{DARK} + I\mathrm{EXT}$$

As will be understood from FIG. 9D, the output characteristics of the dark current IDARK and the output IEXT due to extraneous light are similar to those shown in FIG. 5D.

In the case of FIG. 9C, dark current IDARK and the output IEXT due to extraneous light are produced also when light is emitted by the light-emitting element 15 (this is the situation illustrated in FIG. 9C) in a manner similar to that shown in FIG. 9D. Of course, the output I1 due to reflected light from the light reflecting surface 41 is produced as well in this case (the value of I1 being the same as the value of I1 described in the example of the prior art). Accordingly, the output (I) of the light-receiving element 16 when light is emitted by the light-emitting element 15 is expressed as follows:

$$I = I\mathrm{DARK} + I\mathrm{EXT} + I1$$

Processing for optically detecting whether or not the ink tank is present using the printing apparatus having the construction set forth above will now be described with reference to the flowchart of FIG. 10. It is assumed that this processing is executed when one end of the light reflecting surface 41 of the ink tank 7 has just arrived immediately above the optical unit 14 owing to movement of the carriage 2.

First, at step S100, the MPU 1701 drives the light-emitting element 15 via the controller 32 and LED driver circuit 30 to emit light and the output of the light-receiving element 16 is entered successively at predetermined time intervals while the carriage 2 is moved a predetermined amount. The input signal at this time is filtered of its high-frequency components and converted to a digital value. The digital input values obtained are correlated with the relative positions of the ink tank 7 with respect to the optical unit 14 and stored in the DRAM 1703 as an array A[X], where X represents a relative position when the output of the light-receiving element 16 is entered and A[X] represents the digital value of the output from the light-receiving element 16 at the relative position X.

Next, at step S110, the emission of light from the light-emitting element 15 is halted and the output of the light-receiving element 16 is entered successively at predetermined time intervals while the carriage 2 is reversed in direction and moved a predetermined amount. The input signal at this time is filtered of its high-frequency components and converted to a digital value. The digital input values obtained are correlated with the relative positions of the ink tank 7 with respect to the optical unit 14 and stored in the DRAM 1703 as an array B[X].

This is followed by step S120, at which the MPU 1701, in regard to all positions at which an output signal from the light-receiving element 16 is obtained, calculates A[X]−B[X] at the corresponding positions and stores the result in the DRAM 1703 as C[X]. The MPU 1701 then obtains the maximum value of C[X] at step S130 and makes this CMAX. The MPU 1701 then compares CMAX with a predetermined threshold value a at step S140.

If $\mathrm{CMAX} \geqq \alpha$ holds, control proceeds to step S150, at which it is determined that the ink tank is present. If $\mathrm{CMAX} < \alpha$ holds, control proceeds to step S160, at which it is determined that the ink tank is absent. Printing control (e.g., suspension of printing, display of a message prompting attachment of the ink tank, execution of printing, etc.) in accordance with each judgment rendered is carried out following step S140 or S150.

Figure 10:
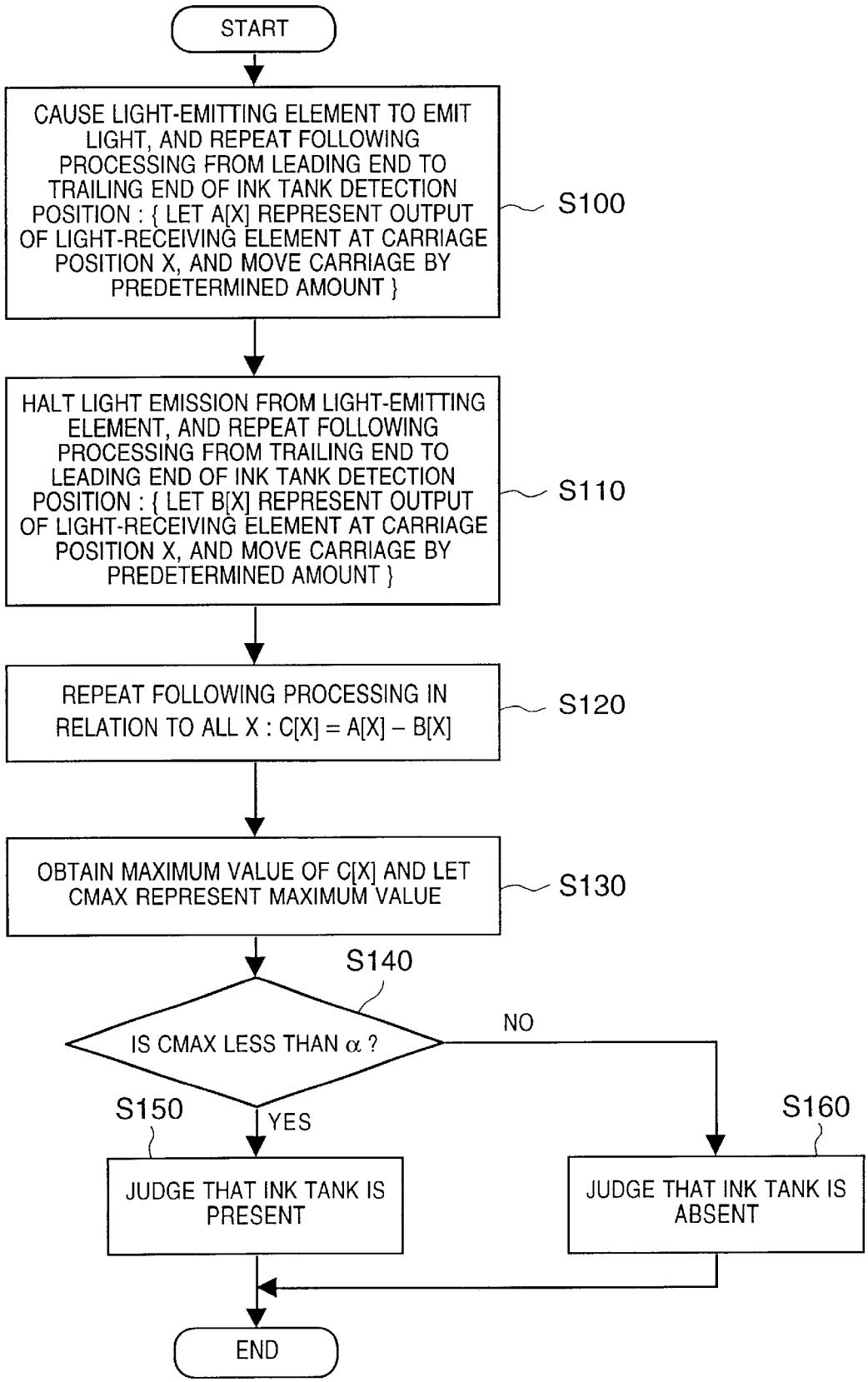
FIG. 10 is a flowchart illustrating processing for optically detecting whether an ink tank is present or not.
Figure 11:
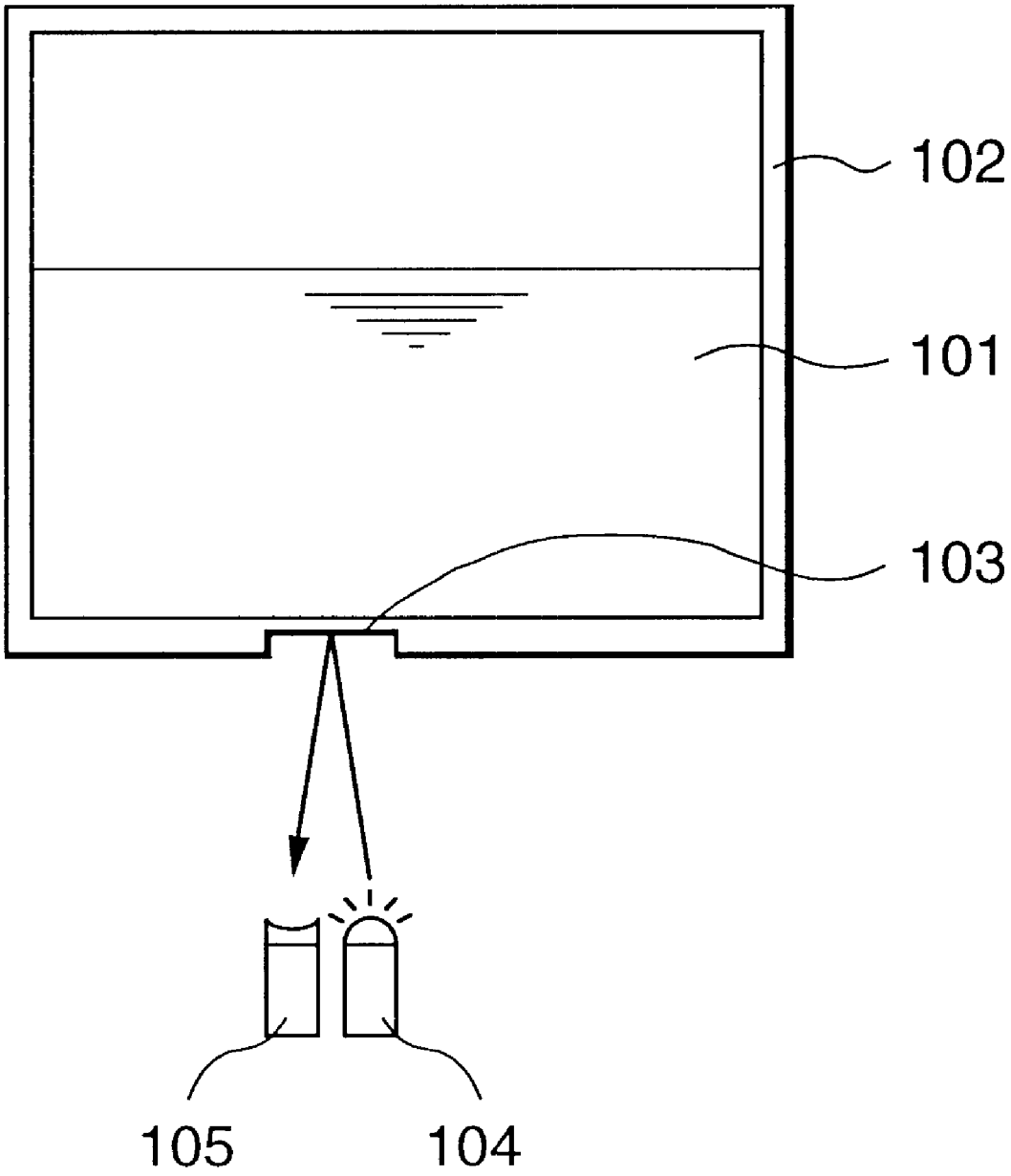
FIG. 11 is a diagram showing schematically a conventional detection principle in accordance with which it is detected whether an ink tank has been installed.
Figure 12:
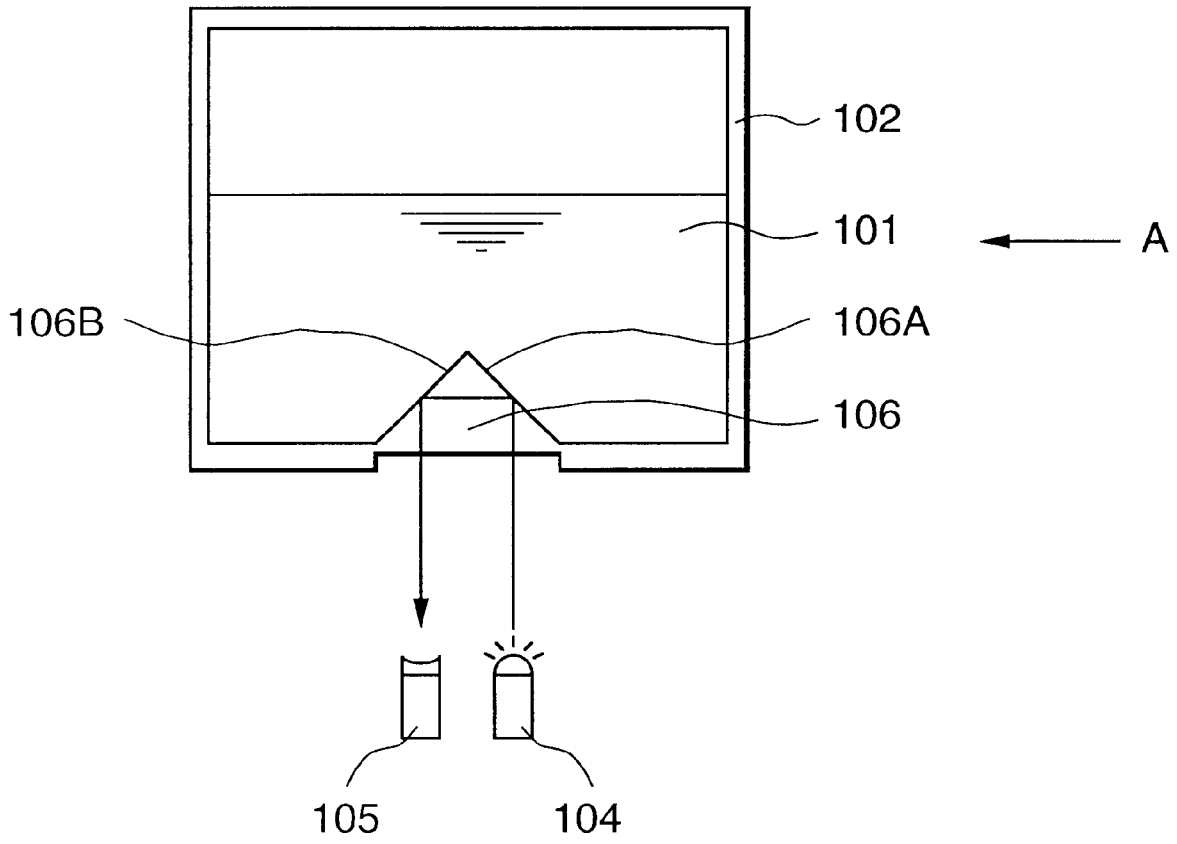
FIG. 12 is a diagram showing an example of the construction of a conventional detection unit for optically detecting whether or not ink is present.

Thus, in accordance with the embodiment described above, executing the processing shown in the flowchart of FIG. 10 eliminates the influence of dark current and extraneous light by removing the amount of light due to the contribution of extraneous light and dark current so as to extract an amount of light ascribable to the contribution from the light-emitting element 15. As a result, whether the ink tank is present or not can be judged more accurately.

In the event that extraneous light penetrates into the interior of the printing apparatus, the contribution of this extraneous light can be canceled by keeping the carriage 2 at the same position and obtaining the difference between the output of the light-receiving element when the light-emitting element emits light and the output of the light-receiving element when the light-emitting element does not emit light. This is advantageous in-that the judgment concerning the presence/absence of the ink tank is not affected even if the influence of extraneous light varies depending upon the position of the carriage (i.e., the position of the ink tank) relative to the optical unit.

As described above, whether ink is present or not and whether an ink tank is present or absent in determined based on the difference between a detection result obtained from a case where the light-emitting element 15 emits a light and another detection result obtained from a case where the light-emitting element 15 does not emit. Thus, an accurate determination can be attained, minimizing influence from an extraneous light and a dark current.

In the embodiments described above, an arrangement is adopted in which the bottom of one ink tank is provided, along the directions in which the carriage travels, with an optical prism used for detecting whether or not ink is present and with a light reflecting surface used for detecting whether or not the ink tank is present. However, in the case of a printing apparatus which attaches great importance to the detecting of the ink tank, an arrangement may be adopted in which the bottom of the ink tank is provided only with the light reflecting surface. In the case of a printing apparatus which attaches great importance to the detecting of ink, an arrangement may be adopted in which the bottom of the ink tank is provided only with the optical prism.

It is mentioned in the foregoing embodiments that the droplets discharged from the printhead are ink droplets and that the fluid contained by the ink tank is ink. However, the contained substance is not limited to ink. For example, in order to improve the fixation and water resistance of a printed image and provide better image quality, a substance such as processed liquid discharged onto the printing medium may be contained within the ink tank.

The embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type printing apparatus and a continuous type printing apparatus. Particularly, in the case of the on-demand type printing apparatus, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only a cartridge type printhead in which an ink tank is integrally arranged on the printhead itself, as described in the above embodiment, but also an exchangeable chip type printhead which can be electrically connected to the apparatus main unit and can receive an ink from the apparatus main unit upon being mounted on the apparatus main unit can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., a host computer, interface, reader, printer, etc.) or to an apparatus comprising a single device (e.g., a copier or facsimile machine, etc.).

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for supplying ink from an ink tank, the ink tank including a prism formed on a predetermined one of a plurality of walls constituting the ink tank used for optically detecting whether or not ink is present, and further including a light-reflecting surface used for optically detecting whether or not the ink tank is present, said printing apparatus performing printing using a printhead according to an ink-jet method, said apparatus comprising:

a light-emitting unit emitting light to at least one of the prism and the light-reflecting surface;

a light-receiving unit receiving light;

difference calculating means for calculating a difference between a first signal, which is obtained from light received by said light-receiving unit in a case where said light-emitting unit emits the light, and a second signal, which is obtained from light received by said light-receiving unit in a case where said light-emitting unit emits no light;

judgment means for judging whether or not ink is present, or whether or not the ink tank is present, based upon the difference calculated by said difference calculating means, wherein said judgment means includes comparison means for comparing the difference obtained by said difference calculating means with a predetermined threshold value, and wherein said judgment means judges whether or not ink is present, or whether or not the ink tank is present, based on result of comparison by said comparison means.

2. The apparatus according to claim 1, wherein said judgment means judges whether or not ink in the ink tank is present based on result of detection by the prism, and judges whether or not the ink tank is present based on result of detection by the light-reflecting surface.

3. The apparatus according to claim 1, further comprising printing control means for performing printing control in accordance with the judgment made by said judgment means.

4. The apparatus according to claim 3, wherein the printing control includes suspension of printing, display of a message prompting replacement or attachment of the ink tank, and resumption of printing.

5. The apparatus according to claim 2, wherein the prism is a light-transmissive optical prism provided on a bottom surface of the ink tank.

6. The apparatus according to claim 2, wherein the light-reflecting surface is provided on a bottom surface of the ink tank.

7. The apparatus according to claim 2, further comprising a scanning unit mounting an ink cartridge integrating the printhead and the ink tank, and reciprocally moving the ink cartridge, wherein the prism and the light-reflecting surface are provided along scanning directions of said scanning unit.

8. The apparatus according to claim 7, wherein said light-emitting unit and said light-receiving unit are provided in a vicinity of a traveling path of the ink cartridge.

9. The apparatus according to claim 8, wherein said light-emitting unit is a light-emitting diode for emitting infrared light, and said light-receiving unit is a phototransistor for receiving the infrared light and converting the received infrared light to an electric signal.

10. The apparatus according to claim 7, wherein the first and second signals are obtained at the same position where the ink tank is situated on the traveling path of the ink cartridge.

11. The apparatus according to claim 10, wherein the first and second signals are obtained at a position where the ink cartridge is situated immediately above a position at which said light-emitting unit and said light-receiving unit are provided.

12. The apparatus according to claim 7, further comprising:

light-emission control means for controlling said light-emitting unit in such a manner that a plurality of the first signals are obtained while the ink cartridge is being moved in a vicinity of the position at which said light-emitting unit and said light-receiving unit are provided; and first maximum value calculation means for calculating a maximum value of the first signals from the plurality of first signals obtained by control performed by said light-emission control means.

13. The apparatus according to claim 12, wherein said light-emission control means performs control so as to stop emission of light by said light-emitting unit and obtain the second signal by said light-receiving means at a location at which the maximum value of the first signals is obtained by said first maximum value calculation means.

14. The apparatus according to claim 7, further comprising:

signal generation control means for performing control in such a manner that a plurality of the first signals and a plurality of the second signals are obtained while the ink cartridge is being moved in the vicinity of the position at which said light-emitting unit and light-receiving unit are provided; and second maximum value calculation means for obtaining a plurality of differences between the plurality of first signals and plurality of second signals at positions where the positions at which the plurality of first signals and plurality of second signals are obtained by said signal generation control means correspond, and calculating a maximum value of the plurality of differences.

15. The apparatus according to claim 14, wherein said judgment means compares the maximum value of the differences obtained by said second maximum value calculation means with a predetermined threshold value, and judges whether or not the ink tank is present, based upon the result of the comparison.

16. The apparatus according to claim 1, wherein said print head is provided with an electrothermal transducer for generating thermal energy applied to the ink in order to discharge the ink by utilizing thermal energy.

17. A printing control method used when supplying ink from an ink tank, the ink tank including a prism formed on a predetermined one of a plurality of walls constituting the ink tank used for optically detecting whether or not ink is present, and further including a light-reflecting surface used for optically detecting whether or not the ink tank is present, said printing control method for performing printing using a printhead according to an ink-jet method, said method comprising:

a first signal acquisition step of acquiring a first signal obtained from light received at a light-receiving portion in a case where at least one of the prism and the light-reflecting surface are irradiated with light from a light-emitting unit;

a second signal acquisition step of acquiring a second signal obtained from light received at the light-receiving portion in a case where the prism and the light-reflecting surface are not irradiated with light from the light-emitting unit;

a difference calculation step of calculating a difference between the first and second signals;

a judgment step of judging whether or not ink is present or whether or not the ink tank is present, based upon the difference obtained at said difference calculation step; and a printing control step of performing printing control in accordance with the judgment result rendered at said judgment step, wherein said judgment step includes a comparison step of comparing the difference obtained at said difference calculating step with a predetermined threshold value, and wherein said judgment step judges whether or not ink is present, or whether or not the ink tank is present, based on result of comparison at said comparison step.

18. The method according to claim 17, wherein said first and second signal acquisition steps acquire the first and second signals in a state in which the ink tank is situated immediately above the light-emitting unit.

19. The method according to claim 17, wherein said first signal acquisition step acquires a plurality of the first signals while the ink tank is being moved relative to the light-emitting unit, and obtains a maximum value of the plurality of first signals that have been acquired.

20. The method according to claim 19, wherein said second signal acquisition step obtains the second signal upon moving the ink tank to a position at which the maximum value was obtained at said first signal acquisition step.

* * * * *

UNITED STATES PATENT AND TRADEMARK OFFICE

CERTIFICATE OF CORRECTION

PATENT NO. : 6,443,546 B1
DATED : September 3, 2002
INVENTOR(S) : Shinji Takagi

It is certified that error appears in the above-identified patent and that said Letters Patent is hereby corrected as shown below:

Column 2,
Line 2, “in” should read -- upon --; and
Line 5, “erectric” should read --electric --.

Column 3,
Line 48, “an” should read -- a --.

Column 4,
Line 20, “while” should read -- while it --; and
Line 56, “beng” should read -- being --.

Column 5,
Line 36, “resultrendered” should read -- result rendered --; and
Line 50, “presented” should read -- present --.

Column 6,
Line 65, “discharges” should read -- ink in a downward direction. The printhead 1 discharges --.

Column 9,
Line 17, “‘I” should read -- I --.

UNITED STATES PATENT AND TRADEMARK OFFICE

CERTIFICATE OF CORRECTION

PATENT NO. : 6,443,546 B1
DATED : September 3, 2002
INVENTOR(S) : Shinji Takagi

It is certified that error appears in the above-identified patent and that said Letters Patent is hereby corrected as shown below:

Column 12,
Line 39, "in-that" should read -- in that --; and
Line 45, "in" should read -- is --.

Column 13,
Line 6, "has" should read -- have --.

Signed and Sealed this

Eighteenth Day of February, 2003

JAMES E. ROGAN
*Director of the United States Patent and Trademark Office*